US009232870B2

(12) United States Patent
Wang

(10) Patent No.: US 9,232,870 B2
(45) Date of Patent: Jan. 12, 2016

(54) STRAW AND LID EQUIPPED THEREWITH

(71) Applicant: DONGGUAN YINYAN PLASTIC CONTAINERS CO., LTD, Dongguan, Guangdong (CN)

(72) Inventor: Zhujin Wang, Dongguan (CN)

(73) Assignee: DONGGUAN YINYAN PLASTIC CONTAINERS CO., LTD, Dongguan (CN)

( * ) Notice: Subject to any disclaimer, the term of this patent is extended or adjusted under 35 U.S.C. 154(b) by 7 days.

(21) Appl. No.: 14/228,314

(22) Filed: Mar. 28, 2014

(65) Prior Publication Data

US 2015/0008220 A1 Jan. 8, 2015

(30) Foreign Application Priority Data

Jul. 8, 2013 (CN) ..... 2013 1 0284408

(51) Int. Cl.
*A47G 21/18* (2006.01)
*A47G 19/22* (2006.01)

(52) U.S. Cl.
CPC ..... *A47G 21/18* (2013.01); *A47G 19/2266* (2013.01)

(58) Field of Classification Search
CPC ... A47G 21/18; A47G 21/183; A47G 21/184; A47G 21/186; A47G 21/189; A47G 19/2222; A47G 19/2266; A47G 19/2272; B65D 27/32; B65D 27/34; B65D 27/38; B65D 77/28
USPC ..... 220/703, 705, 707, 708, 709, 710, 220/203.27, 203.29, 367.1; D7/300, 300.2, D7/305; 215/388, 390, 391, 229
See application file for complete search history.

(56) References Cited

U.S. PATENT DOCUMENTS 6,230,923 B1 * 5/2001 Hung ..... 220/703
8,186,537 B2 * 5/2012 Rosnak et al. ..... 220/705
8,376,165 B2 * 2/2013 Chiang ..... 215/388

FOREIGN PATENT DOCUMENTS

CN 2180256 Y 10/1994

* cited by examiner

*Primary Examiner* — Steven A Reynolds
*Assistant Examiner* — Javier A Pagan

(57) ABSTRACT

A straw includes a straw body, an air return flap and a retaining ring, both the air return flap and the retaining ring are provided on the straw body, and the retaining ring is located above the air return flap and spaced apart from the air return flap. A lid equipped with the straw includes a lid body and an inserting hole, the inserting hole is provided on the lid body and is used for passing the straw therethrough. The present application can achieve the effect of automatic air return, the structure of which is simple, the air return effect is better, and the straw and the lid functioning to air return is easy to clean after being disassembled.

8 Claims, 5 Drawing Sheets

STRAW AND LID EQUIPPED THEREWITH

CROSS-REFERENCE TO RELATED APPLICATIONS

The present application claims the benefit of Chinese patent application No. 201310284408.1 filed on Jul. 8, 2013; the contents of which are hereby incorporated by reference.

FIELD OF THE INVENTION

The present application relates to the field of cup device, and particularly to a straw and a lid equipped therewith.

BACKGROUND OF THE INVENTION

The straw-type cup for drinking used for child or baby on the current market has following questions in general.

For the existing common straw-type cup for drinking, the straw is directly inserted into the cup from the lid, and no special arrangement is performed on both the straw and the lid. In the process of user feeding child or baby with water or milk, if the child or baby is naughtier and bites the nipple without releasing it, as long as the user applies force a little harder, the straw will be drawn out from the feeding bottle, thus causing inconvenience to user.

Furthermore, for the straw-type cup for drinking available on the current market, in the process of using it to feed child or baby with water or milk, there is a drawback that air return can not be achieved. Therefore, with the reduction of the liquid in the cup, such as water or milk, negative pressure will be formed in the cup, and the cup may be recessed or flattened, resulting in difficulty in sucking for child or baby, if terrible, may choke the vulnerable trachea of baby. Only by releasing the straw so that the air pressures inside and outside the cup keep balance can child or baby continue to have a feed; if drawing the nipple out of the mouth of baby to return air for the feeding bottle while the baby is drinking milk, the baby will often cry and scream, thus affecting the health of baby.

For some feeding bottles, a ventilating hole is provided on the feeding bottle or on the nipple; actually, returning air smoothly can not be achieved in this way. At present, a feeding bottle with anti-falling out nipple is available, for example Chinese patent NO. ZL94202689.6 titled "AIR RETURN BY STRAIGHT SUCTION TYPE FEEDING BOTTLE", which performs air return by employing a U-shaped tube, although the air return effect can be achieved, the structure of which is too complex, the cost of manufacture of which is high, and which is difficult to clean, thus bringing hidden danger to the health of baby.

For some cups, a ventilating hole is provided on the cup lid, and the ventilating hole is covered by a perforated rubber sheet, thereby avoiding spill of the cup, however, the structure of the cup is too complex, the cup is difficult to clean, and small parts can be damaged easily and then fall into the mouth of child.

SUMMARY OF THE INVENTION

The technical problem to be solved by the present application is to provide a straw and a lid equipped therewith, by using the straw and the lid provided by the present application on the cup or feeding bottle, in the process of using the cup or feeding bottle, automatic air return between the inside of the cup and the outside of the cup can be achieved, and the design structure of the device is simple, the device is easy to clean and has high security.

In order to achieve the above objects, the present application provides the following technical solutions.

A straw including a straw body, an air return flap and a retaining ring, wherein both the air return flap and the retaining ring are provided on the straw body, and the retaining ring is located above the air return flap and spaced apart from the air return flap.

Furthermore, the air return flap is of a ring shape, the air return flap is connected with a outer wall of the straw body, and a angle formed by a portion at which the air return flap and the outer wall of the straw body are connected, a edge of the air return flap and the straw body is a acute angle.

Furthermore, the thickness of the air return flap is gradually reduced from the portion at which the air return flap and the outer wall of the straw body are connected to the edge of the air return flap.

Furthermore, the air return flap is made of silicone or soft material.

A lid equipped with the straw including a lid body and a inserting hole, wherein the inserting hole is provided on the lid body and is used for passing the straw therethrough, the retaining ring is located at the side of the lid body that contacts with environment, and the air return flap is located at the side of the lid body that contacts with the cup body.

Furthermore, the diameter of the inserting hole is equal to the outer diameter of the straw.

Furthermore, the diameter of the inserting hole is less than the outer diameter of the straw.

Furthermore, the lid further includes an air return hole, wherein the air return hole is provided on the lid body and located close to the inserting hole.

Furthermore, the air return flap completely covers the air return hole.

Furthermore, the lid further includes an air outlet, wherein the air outlet is provided on the lid body and is used for leading out the air inside the cup body from the cup body.

Furthermore, the lid further includes a seal ring, wherein the seal ring is provided on an inner surface of the lid body and is used for forming a seal between the lid body and the cup body.

Furthermore, the seal ring is provided with a seal cap used for sealing the air outlet.

Furthermore, the seal ring and the seal cap are made of silicone or soft material.

Furthermore, the seal cap is provided with a gap used for leading air.

Furthermore, the gap is formed by cutting a cross on the seal cap.

For the straw and the lid equipped therewith involved in the present application, the straw body is provided with the air return flap and the retaining ring, the lid is provided with the inserting hole and the air return hole, by the straw body and the lid cooperating with each other in use, in the process of sucking out water by using the straw, the liquid is sucked out through the straw so that a negative pressure will be generated inside the cup, consequently, the outside atmosphere sequentially passes through the air return hole, pushes away the air return flap and goes into the inside of the cup, thus achieving air return. If the water is not sucked out, there is no negative pressure inside the cup, the air pressure inside the cup is sufficient to tightly close the air return hole through the air return flap, the liquid will not leak out through the air return hole due to rocking the cup. Even though the cup is placed upside down, the water will not leak out through the air return flap. In addition to achieving the air return function, the air return flap can fix the position of the straw relative to the cup, preventing the straw from being drawn out by child and then resulting in water spilling from the straw hole.

As compared with the prior art, the present application not only can prevent the straw from falling out from a device, such as the cup or the feeding bottle, but also can achieve the effect of automatic air return, the structure of which is simple, the air return effect is better, and the straw and the lid functioning to air return is easy to clean after being disassembled. Furthermore, for devices such as existing common cup or feeding bottle, the straw and the lid according to the present application can be conveniently mounted thereon, thus they can be converted into a cup or feeding bottle that can achieve air return, thus improving the utilization of raw material and achieving economy and environmental protection effect.

BRIEF DESCRIPTION OF THE DRAWINGS

In order to illustrate embodiments of the present application or technical solutions in the prior art more clearly, drawings required in the descriptions of the embodiments or the prior art will be described briefly hereinafter, obviously, the drawings in the following description are only some embodiments of the present application, and those skilled in the art can also obtain other drawings from these drawings without any creative work.

Figure 1:
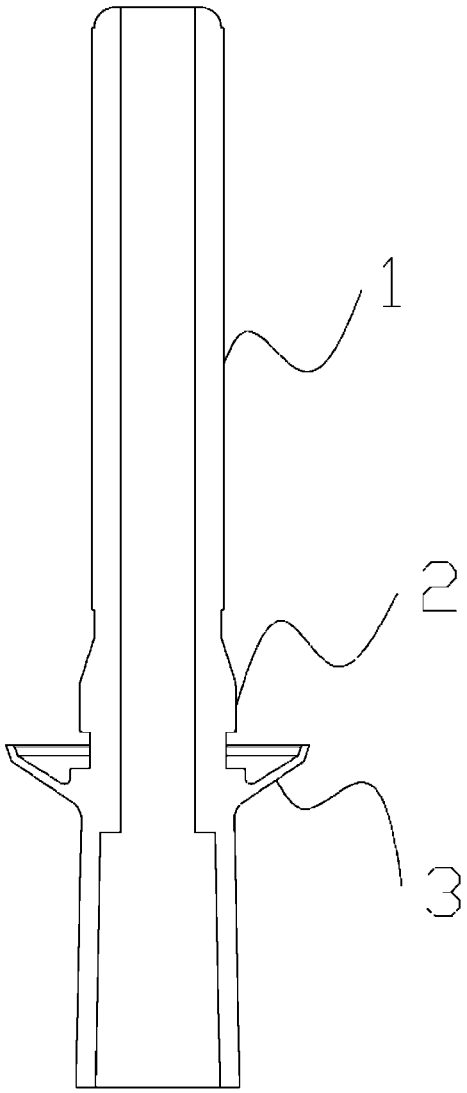
FIG. 1 is a sectional schematic view of a straw according to an embodiment of the present application.

Reference numerals in the above FIGS. 1 to 5:

| | | | |
|---|---|---|---|
| 1 | straw body | 2 | retaining ring |
| 3 | air return flap | 4 | air return hole |
| 5 | inserting hole | 6 | lid body |
| 7 | inside of the lid | 8 | outside of the lid |
| 9 | air outlet | 10 | seal ring |
| 11 | seal cap | 12 | gap |

DETAILED DESCRIPTION OF THE INVENTION

In order to make the object, technical solutions and advantages of the present application more clearly, technical solutions in the embodiments of the present application will be described hereinafter clearly and completely in conjunction with the accompanying drawings and the embodiments of the present application. It should be noted that the embodiments are only a part of the embodiments of the present application, rather than all embodiments. All other embodiments obtained based on the embodiments in the present application by those skilled in the art without any creative work should be considered as falling into the scope of protection of the present application.

As shown in FIG. 1, FIG. 1 is a sectional schematic view of a straw according to the present embodiment (it should be noted that the straw is preferably of a round tube shape according to the present embodiment, and an overall schematic view of the straw is omitted here). The straw includes a straw body 1, a retaining ring 2 and an air return flap 3. Each of the retaining ring 2 and the air return flap 3 is of a ring structure and connected tightly with an outer wall of the straw body 1, preferably, the retaining ring 2 and the air return flap 3 are integrally formed with the straw body 1 according to the present embodiment. A distance is formed between the retaining ring 2 and the air return flap 3, the size of the distance depends on a lid (which will be described hereinafter) matched therewith in use and should be determined in a manner that the straw can be fastened on the lid when passing therethrough. A angle formed by a edge of the air return flap 3, a portion at which the air return flap 3 and the straw body are connected and the straw body 1 is a acute angle, and a space formed among the edge of the air return flap 3, the portion at which the air return flap 3 and the straw body are connected and the straw body 1 has a small curvature. The thickness of the air return flap 3 is gradually reduced from the portion at which the air return flap 3 and the straw body 1 are connected to the edge of the air return flap 3. Preferably, the material used by the air return flap 3 according to the present embodiment is soft material.

Figure 2:
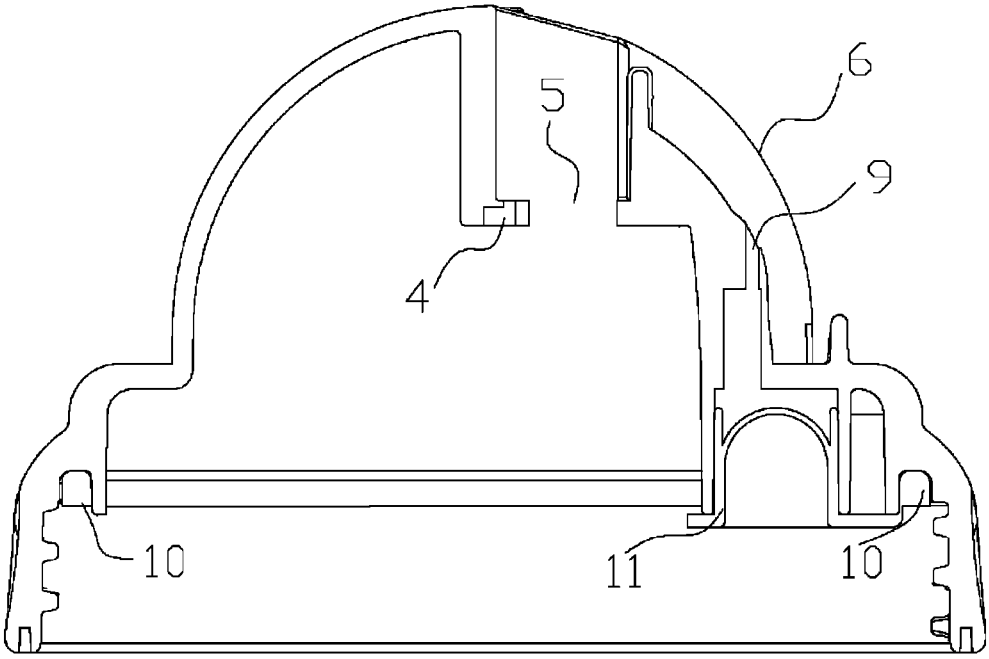
FIG. 2 is a sectional schematic view of a lid according to an embodiment of the present application.

As shown in FIG. 2, FIG. 2 is a sectional schematic view of a lid equipped with the straw according to the present embodiment according to the present embodiment (it should be noted that the lid is preferably of a circular shape according to the present embodiment, and an overall schematic view of the lid is omitted here). The lid includes an air return hole 4, a inserting hole 5 and a lid body 6, the inserting hole 5 is provided on the lid body 6, and the diameter of the inserting hole 5 is preferably equal to the outer diameter of the straw body 1 according to the present application. The material of the straw generally is soft material which has controllability on deformation; the diameter of the inserting hole 5 also can be slightly less than the outer diameter of the straw body. The air return hole 4 is provided on the lid body 6, and when the lid body 6 is covered on the cup corresponding therewith, air circulation can be performed between the outside of the lid 8 (i.e., the side of the lid body 8 that contacts with environment) and the space of the inside of the lid 7 (i.e., the side of the lid body 8 that contacts with the cup body) through the air return hole 4, thereby achieving the effect of air return. The air return hole 4 is provided close to the inserting hole 5, and the precise position of the air return hole 4 is located in a manner that the air return flap 3 on the straw body 1 can completely covers the air return hole 4.

Figure 4:
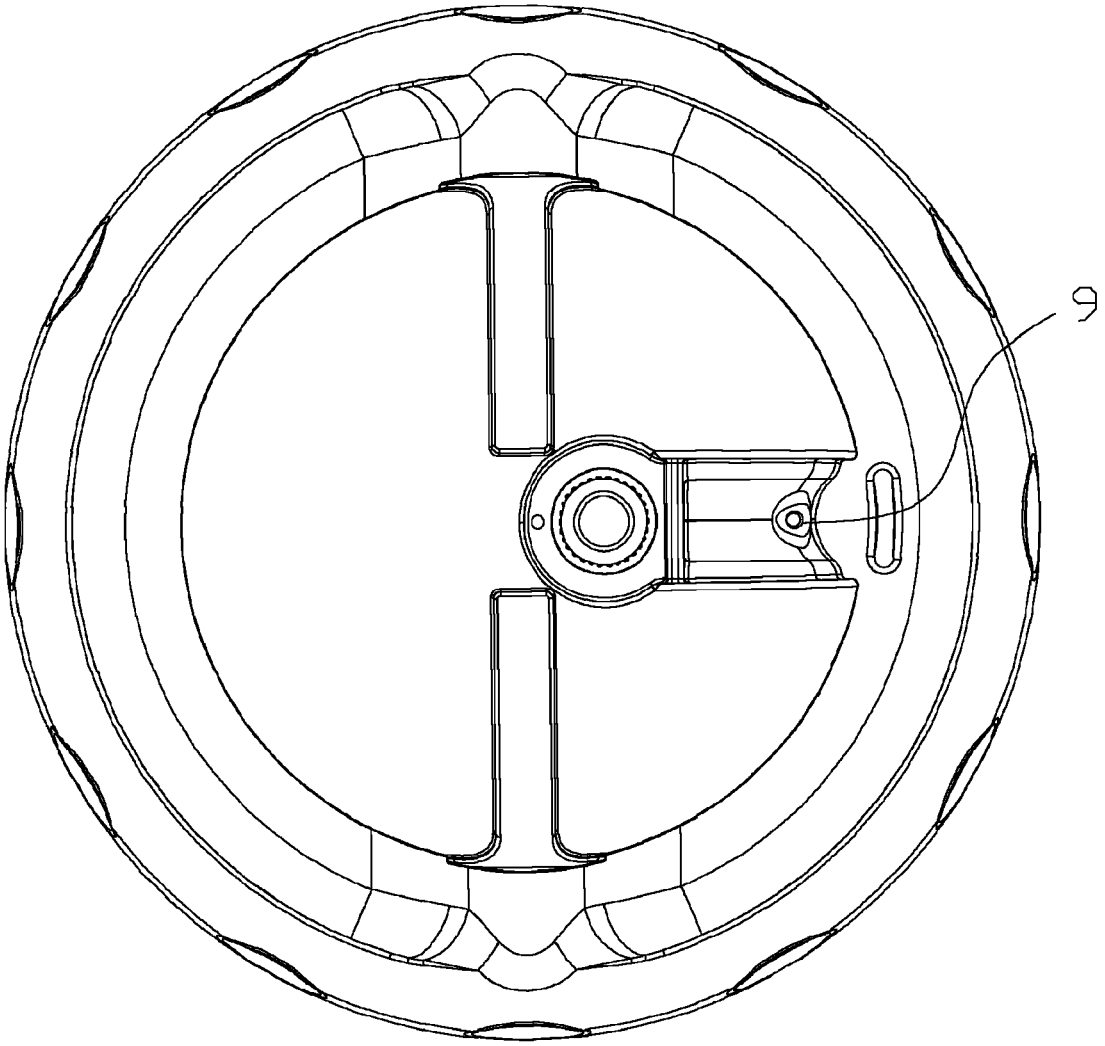
FIG. 4 is a top view of the lid according to an embodiment of the present application.
Figure 5:
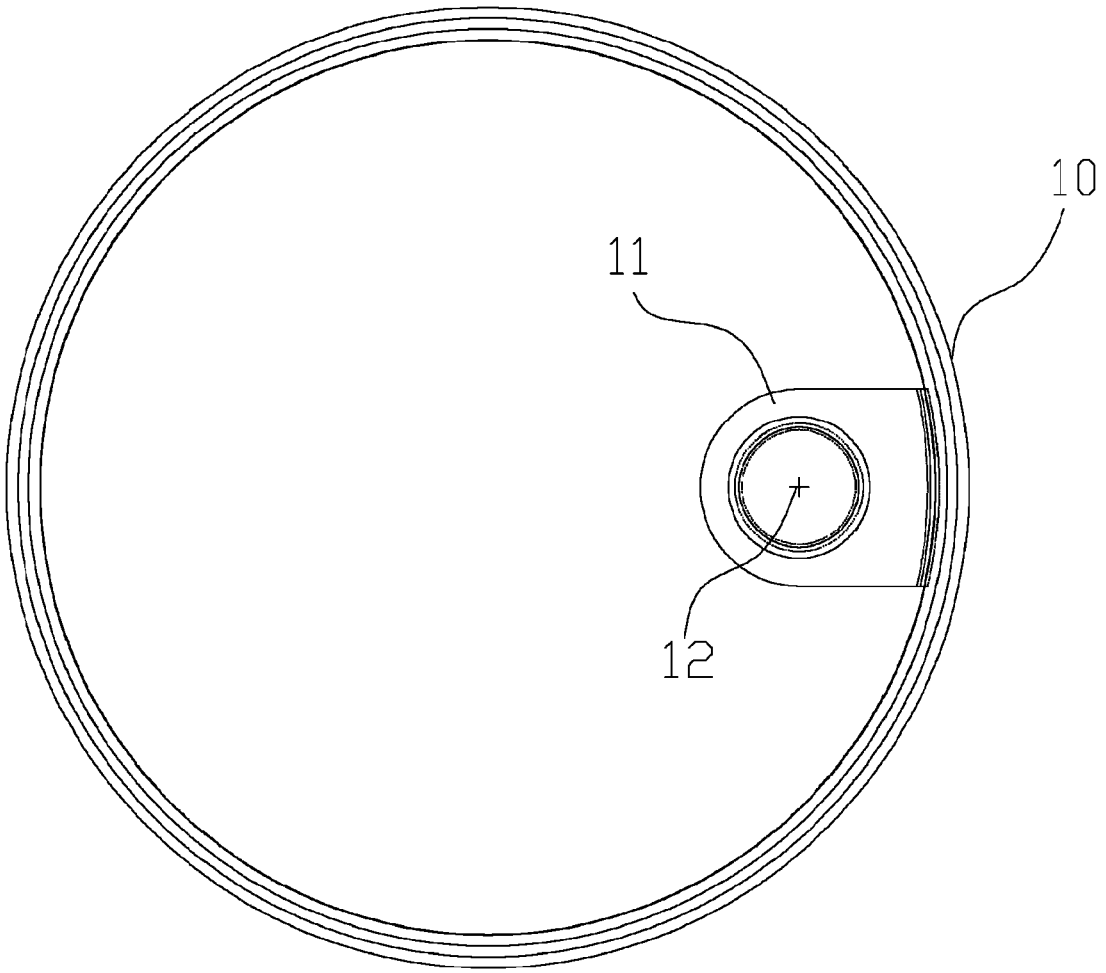
FIG. 5 is a schematic view of a seal ring inside the lid according to an embodiment of the present application.

Preferably, as shown in FIG. 2 and FIG. 4, the lid further includes an air outlet 9; the air outlet 9 is provided on the lid body 6 and is used for leading out the air inside the cup body from the cup body. The lid further includes a seal ring 10; the seal ring 10 is provided on an inner surface of the lid body 6 and is used for forming a seal between the lid body 6 and the cup body. Furthermore, as shown in FIG. 2 and FIG. 5, the seal ring 10 is provided with a seal cap 11 used for sealing the air outlet 9. The seal cap 11 is provided with a gap 12 used for leading air. Preferably, the gap 12 according to the present application is formed by cutting a cross on the seal cap 10. Since the gap 12 is formed by cutting the cross on the seal cap 10, the gap 12 only can lead the air from the inside of the cup body to the outside of the cup, and water or other liquid can not be led from the inside of the cup body to the outside of the cup through the gap 12. Preferably, the seal ring 10 and the seal cap 11 according to the present application are made of silicone.

As described above, the structures of both the straw and the lid equipped therewith involved in the present embodiment are explained preliminarily, and the specific operating principle with the straw and the lid equipped therewith according to the embodiment matching with each other for use will be explained in detail in conjunction with FIG. 3 hereinafter.

Figure 3:
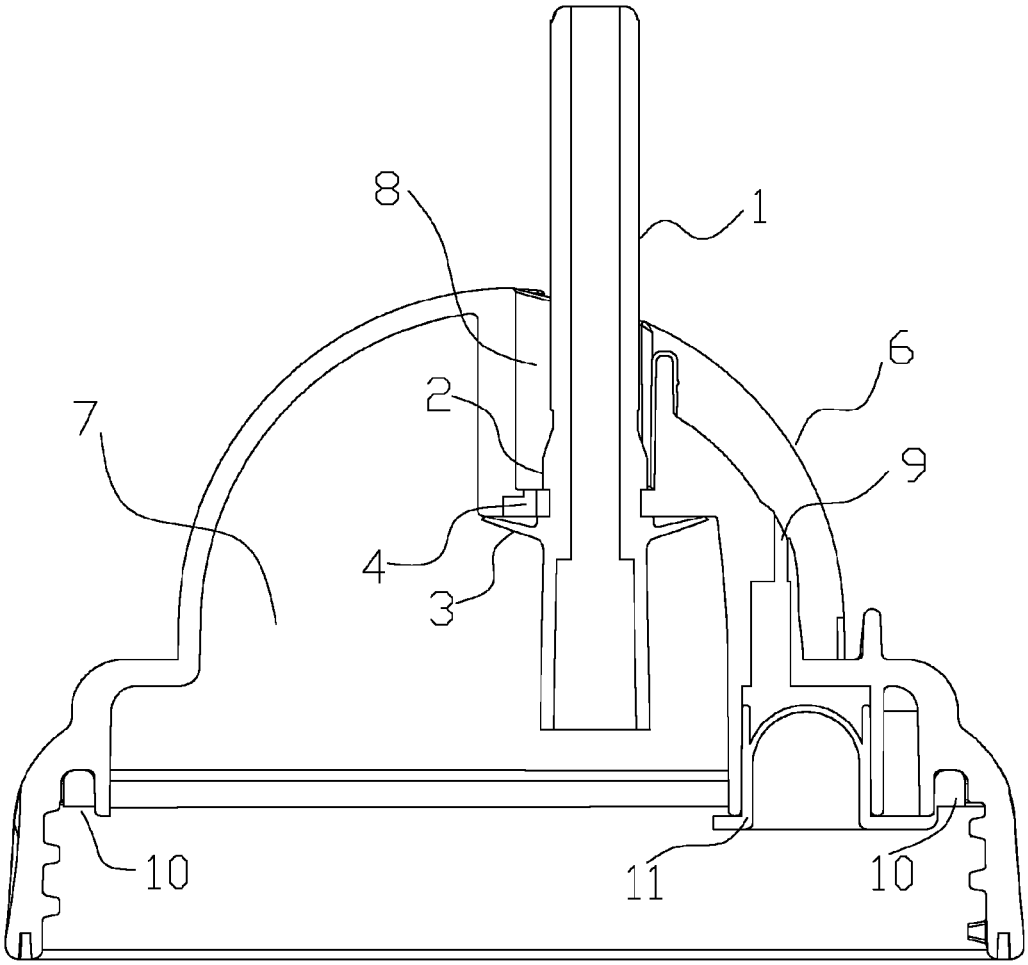
FIG. 3 is a sectional schematic view indicating that the straw and the lid according to the embodiments of the present application are combined together.

As shown in FIG. 3, when the straw body 1 is inserted into the inserting hole 5, the retaining ring 2 and the air return flap 3 cooperate with each other to fix the straw body 1 on the lid body 6, so that it is difficult to draw the straw body 1 from the lid body 6. The retaining ring 2 is located at the outside of the lid 8 and clamps a portion of the lid that closes to the inserting hole 5. The air return flap 3 is located at the inside of the lid 7 and completely covers the air return hole 4.

For convenience, a cup is taken as an example in the following description. In the process of user of the cup sucking out water by using the straw body 1, the liquid in the cup is sucked out through the straw body 1 so that a negative pressure will be generated in the inside of the lid 7, consequently, the outside atmosphere sequentially passes through the air return hole 4, pushes away the air return flap 3 and goes into the inside of the lid 7, thus achieving air return between the inside of the lid 7 and the outside of the lid 8, thereby the air pressures between the inside of the lid 7 and the outside of the lid 8 reaches balance, the deformation of the cup body of the cup can be effectively prevented, and it is more convenient for the user to suck out the object inside the cup. If the user does not suck out the object inside the cup through the straw body 1, there is no negative pressure in the inside of the lid 7, the air pressure in the inside of the lid 7 is sufficient to press down the air return flap 3, thereby sealing the air return hole 4, the object in the inside of the lid 7 will not leak to the outside of the lid 8 through the air return hole 4 due to rocking the cup by user. Even though the cup is placed upside down, the object in the cup will not leak to the outside of the lid 8 through the air return hole 4.

For the straw and the lid equipped therewith involved in the present embodiment, the straw body 1 is provided with the air return flap 3 and the retaining ring 2, the lid body 6 is provided with the inserting hole 5 and the air return hole 4, the straw body 1 and the lid body 6 cooperate with each other in use, so that the retaining ring 2 presses against the portion of the lid that is located at the outside of the lid 8, the air return flap 3 presses against the portion of the lid that is located at the inside of the lid 8, in other words, the retaining ring 2 and the air return flap 3 fix the straw body 1 on the lid body 6, so that it is difficult to draw out the straw body from the lid body 6, thereby the object in the inside of the lid is prevented from leaking to the outside of the lid 8 through the inserting hole. And as can be seen from the above description, by the air return hole 4 and the air return flap 3 cooperating with each other, the air return effect can be achieved nicely.

As compared with the prior art, the present application not only can prevent the straw from falling out from a device, such as the cup or the feeding bottle, but also can achieve the effect of automatic air return, the structure of which is simple, the air return effect is better, and the straw and the lid functioning to air return is easy to clean after being disassembled. Furthermore, for devices such as existing common cup or feeding bottle, the straw and the lid according to the present application can be conveniently mounted thereon, thus they can be converted into a cup or feeding bottle that can achieve air return, thus improving the utilization of raw material and achieving economy and environmental protection effect.

The embodiment described above is only one embodiment of the present application and the description of which is relatively specific and detailed, which should not be considered as limitations to the scope of the present application. It should be noted that, those skilled in the art may make various improvements and modifications to the present application without departing from the concept of the present application, and these improvements and modifications should also fall into the protection scopes of the claims of the present application. Therefore the scope of protection of the present application should be defined by the claims.

What is claimed is:

1. A lid comprising a lid body formed with an air return hole and an inserting hole for passing therethrough a straw, the straw comprising a straw body, an air return flap, and a retaining ring, the air return flap being located on an inner surface of the lid body and adapted to cover the air return hole, and the retaining ring being located on an outer surface of the lid body;

wherein the lid further comprises an air outlet formed on the lid body for leading air from inside to outside of a cup covered by the lid body;

wherein the lid further comprises a seal ring snap-fitted into a downwardly facing annular groove formed on the inner surface of the lid body to form a seal between the lid body and the cup;

wherein a flexible tongue-shaped tab is integrally formed on and extending radially inwardly from the seal ring, and a dome-shaped seal cap is integrally formed on and extending upwardly from the tab, the dome-shaped seal cap being inserted into a tubular portion formed on the inner surface of the lid body in communication with the air outlet to thereby seal the air outlet, and the seal cap being formed with a cross-shaped gap; and wherein an edge of the flexible tongue-shaped tab defines a finger-gripping tab portion adapted to be gripped by a user's fingers to facilitate inserting and pulling the tab into and out of the tubular portion.

2. The lid according to claim 1, wherein the air return flap is of a ring shape, the air return flap is connected with an outer wall of the straw body, and an angle formed by a portion at which the air return flap and the outer wall of the straw body are connected, an edge of the air return flap and the straw body is an acute angle.

3. The lid according to claim 2, wherein the thickness of the air return flap is gradually reduced from the portion at which the air return flap and the outer wall of the straw body are connected to the edge of the air return flap.

4. The lid according to claim 1, wherein the air return flap is made of silicone or soft material.

5. The lid according to claim 1, wherein the diameter of the inserting hole is equal to the outer diameter of the straw.

6. The lid according to claim 1, wherein the diameter of the inserting hole is less than the outer diameter of the straw.

7. The lid according to claim 1, wherein the air return flap completely covers the air return hole.

8. The lid according to claim 1, wherein the seal ring and the seal cap are made of silicone or soft material.

* * * * *